US006846562B1

(12) United States Patent
Vogt et al.

(10) Patent No.: US 6,846,562 B1
(45) Date of Patent: Jan. 25, 2005

(54) METHOD OF FORMING LIGHT DISPERSING FIBER AND FIBER FORMED THEREBY

(75) Inventors: Kirkland W. Vogt, Simpsonville, SC (US); Daniel T. McBride, Chesnee, SC (US); Robert M. Smith, Gross Ile, MI (US)

(73) Assignee: Milliken & Company, Spartanburg, SC (US)

( * ) Notice: Subject to any disclaimer, the term of this patent is extended or adjusted under 35 U.S.C. 154(b) by 67 days.

(21) Appl. No.: 10/635,262

(22) Filed: Aug. 6, 2003

(51) Int. Cl.[7] ..... D01F 6/00
(52) U.S. Cl. ..... 428/376; 428/395
(58) Field of Search ..... 428/376, 398

(56) References Cited

U.S. PATENT DOCUMENTS

| | | | |
|---|---|---|---|
| 1,394,270 | A | 10/1921 | Brandenberger |
| 2,531,665 | A | 11/1950 | Booth |
| 2,590,156 | A | 3/1952 | Carpentier |
| 2,751,627 | A | 6/1956 | Lindemann |
| 3,227,664 | A | 1/1966 | Blades et al. |
| 3,389,446 | A | 6/1968 | Parrish |
| 3,436,445 | A | 4/1969 | Brunner et al. |
| 3,806,291 | A | 4/1974 | Hendrey |
| 3,949,031 | A | 4/1976 | Fairbanks |
| 3,988,404 | A | 10/1976 | Orimo et al. |
| 4,164,603 | A | 8/1979 | Siggel et al. |
| 4,360,484 | A | 11/1982 | Rubens |
| 4,380,594 | A | 4/1983 | Siggel et al. |
| 4,473,665 | A | 9/1984 | Martini-Vvedensky et al. |
| 4,728,472 | A | 3/1988 | Windley |
| 4,728,559 | A | 3/1988 | Hardenbrook et al. |
| 4,752,514 | A | 6/1988 | Windley |
| 4,753,762 | A | 6/1988 | Li et al. |
| 4,761,256 | A | 8/1988 | Hardenbrook et al. |
| 5,158,986 | A | 10/1992 | Cha et al. |
| 5,223,545 | A | 6/1993 | Kumar |

FOREIGN PATENT DOCUMENTS

| | | |
|---|---|---|
| GB | 527951 | 5/1940 |
| WO | WO 97/06935 | 2/1997 |

OTHER PUBLICATIONS

Article "Plasticization of Glassy Polymers by $CO_2$," from Journal of Applied Polymer Science, by J.S. Chiou et. al., vol. 30, 2633–2642, 1985.
Article "In Situ Drawing of High Molecular Weight Poly (ethylene terephthalate) in Subcritical and Supercritical $CO_2$," from Journal of Polymer Science: Part B: Polymer Physics, by Hobbs et. al., vol. 37, 1881–1891, 1999.
Article "MuCell Microcellular Foams Enter Continuous Production," dated Aug. 6, 2003, from www.trexel.com/techpp/contrprod.html.
Thesis: Sorption and Transport Behavior of Miscible Polymer Blends, by Jen–shan Chiou, May 1985, The University of Texas at Austin, University of Microfilms International, Ann Arbor, MI, attention to pp. 96–98; 103.
Thesis: The Processing of Microcellular Foam, by Francis Abbott Waldman, Jan. 1982, Massachusetts Institute of Technology, attention to pp. 11–14, and 93–95.
Thesis: The Production and Analysis of Microcellular Foam, by Jane Ellen Martini, Jan. 1981, Massachusetts Institute of Technology, attention to pp. 16–19.
Thesis: A Microcellular Foaming/Forming Process Performed at Ambient Temperature and a Super–microcellular Foaming Process, by Sung Woon Cha, Apr. 1994, Massachusetts Institute of Technology, attention to pp. 24, 26, 29, 95, and 99–102.

*Primary Examiner*—N. Edwards
(74) *Attorney, Agent, or Firm*—Terry T. Moyer; Sara M. Current

(57) ABSTRACT

Polymeric structures produced with a controlled number and distribution of small, closed cells. The polymeric structures are characterized by an opaque, whitening appearance attributed, at least in part, to the distribution of closed cells and thus, at least in part, to light scattering resulting from the distribution of small, closed cells or voids. The light scattering thus provides an enhanced whitening effect. The whitening effect may be uniform or non-uniform along the length and width of the structure.

25 Claims, 4 Drawing Sheets

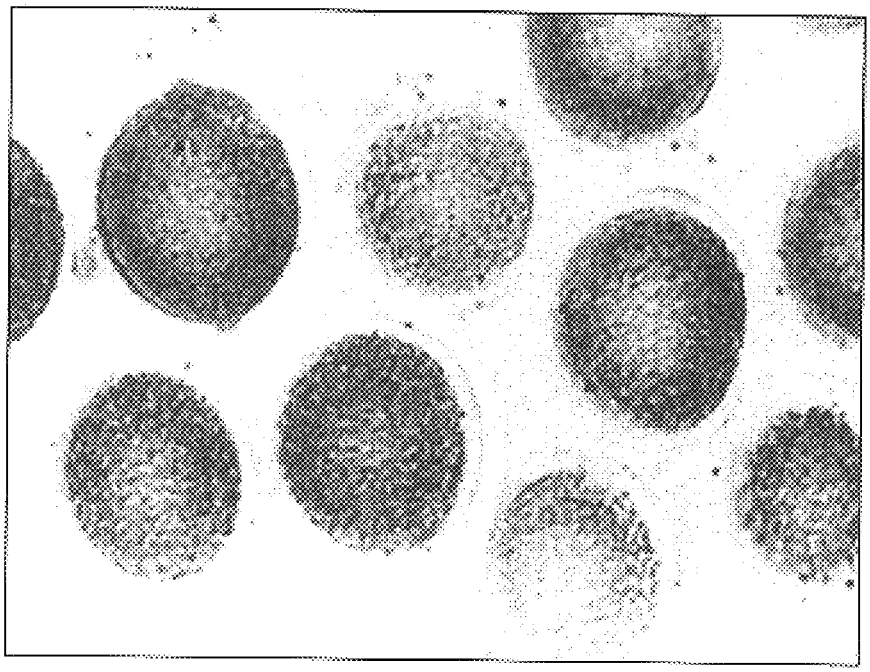
FIG. –1A–
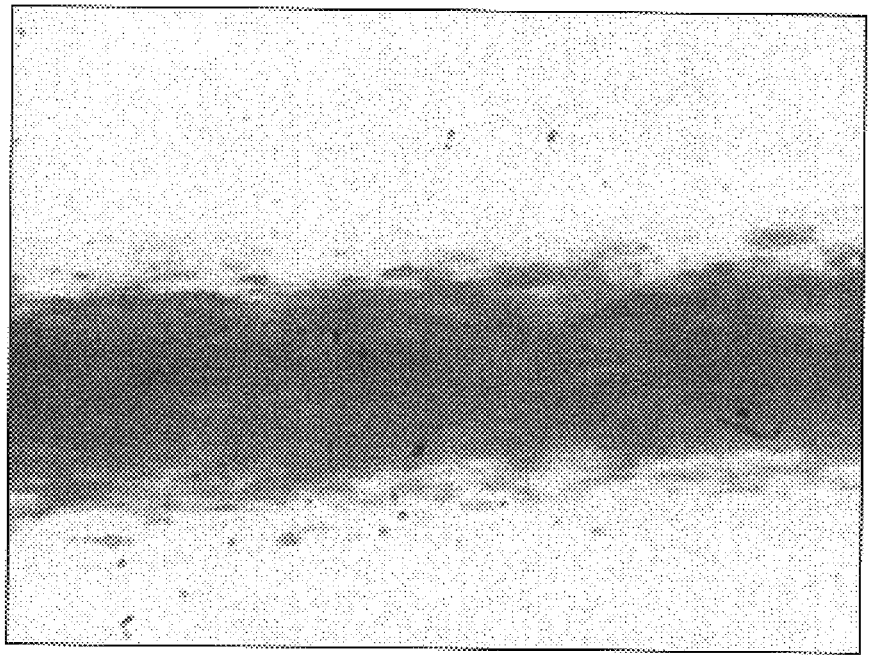
FIG. –1B–

METHOD OF FORMING LIGHT DISPERSING FIBER AND FIBER FORMED THEREBY

FIELD OF THE INVENTION

This invention relates to modified polymeric fibers and yarns formed therefrom that have an enhanced ability to scatter light, thereby selectively enhancing opacity as a result of the modification. Such increased opacity enhances the whiteness of the fibers and yarns and fabrics formed therefrom. More specifically, the invention relates to modified fibers and yarns and fabrics formed therefrom in which such fibers have a controlled number and distribution of closed cells. This invention also relates to methods of forming the closed cells in fibers or other precursor structures such as films, sheets, ribbons and the like.

BACKGROUND OF THE INVENTION

Porous, cellular material can be generally described as having either closed cells, in which the cells or pores are not interconnected, or open cells, in which the cells or pores are interconnected and may extend to the surface of the material in which they are formed and display the structure and appearance of open pits. The cellular fibers of the present invention predominantly contain the closed type of cells.

In the past, cell formation has been used in thermoplastic sheet materials using practices as described in U.S. Pat. Nos. 2,531,665; 2,751,627; 4,473,665; and 5,158,986 the teachings of which are all incorporated by reference as if fully set forth herein. However, the technology embodied in these patents which addresses cell formation in thermoplastic sheet materials and methods to reduce out-diffusion of an impregnating gas to increase nucleation is not believed to be adaptable to forming fibers.

In the past, cell formation has been achieved in fibers by dispersing blowing agents into the molten polymer prior to extrusion. A wide variety of agents has been used including air, nitrogen, chlorinated fluorocarbons, and other gases, as well as volatile materials that are gaseous at molten polymer temperatures, such as methylene chloride and other halogenated hydrocarbons, materials that decompose to form gas products (such as azides), and materials that react to form gaseous products, such as acids and carbonates. The blowing agent may be added to the precursor resin or dispersed into the molten polymer. For example, U.S. Pat. No. 4,164,603 and divisionally related U.S. Pat. No. 4,380,594 (both incorporated by reference herein) are directed to processes and fibers with variable cells formed using a silicon blowing agent. U.S. Pat. No. 4,728,472 (incorporated by reference) describes a process to produce fibers with closed cells that requires the introduction of a fluorocarbon blowing agent into a molten polymer. While it is possible to achieve a percentage of closed cells using a blowing agent in a fiber extrusion process, experience indicates that the process yields a material with an undesirably high closed cell length to diameter ratio (greater than 500 and up to 2,000). Moreover, such processes may produce undesired levels of open cells.

In actual practice there are two primary drawbacks to the process of simultaneously extruding and foaming fibers to generate a cellular structure. First, such practices give rise to enhanced manufacturing difficulty due to the complexity of the process. Second, such practices generally provide poor uniformity. In particular, when extruding foamed fibers it is extremely difficult to extrude small uniform fibers without breaking the filaments. The polymer filaments have lower tenacity making it difficult to draw them properly. The lower tenacity also makes it more difficult to properly texture the yarn, so it loses body and texture that is needed in the final fabric. Further, during yarn formation it is difficult to spin foamed fiber at the same rate and quality as non-foamed fiber. In addition, many of the additives used to improve production rate, such as silicon oil or polydimethylsiloxane are undesirable in the final fabric. Such additives can have such adverse effects as creating uneven dyeings, leaving deposits on the processing machinery, and increasing the flammability of the fabric. It is also believed to be difficult to controllably vary the level of opacity at different zones along the length of the fiber when foaming and extrusion are carried out simultaneously. The ability to provide such controlled variation may be desirable for some applications.

As regards the above-referenced problem of poor uniformity, it is not possible to control the shape, size and distribution of the cells during simultaneous foaming and extrusion. In particular, the closed cells of fibers formed from simultaneous extrusion and foaming have undesirably high length to diameter (L/D) ratios. More specifically, in such prior art fibers the cells nucleate coming out of the extrusion head and the L/D (length to diameter ratio) increases as the fiber is drawn down to the desired denier. Although the cells have a large volume, the number of cells per unit length is consequently small. Conversely, greater light scattering corresponding to enhanced opacity (which is desirable to enhance whiteness) is achieved by a larger number of cells per unit length and, therefore, a larger surface area.

SUMMARY OF THE INVENTION

According to one aspect of the present invention, a polymeric fiber with a controlled number and distribution of small, closed cells is provided. This polymeric fiber is characterized by an opaque appearance attributed, at least in part, to the distribution of closed cells in the fiber and thus, at least in part, to light scattering resulting from the distribution of small, closed cells or voids in the fiber. The light scattering thus provides an enhanced whitening effect within the fiber.

According to another aspect of the invention, methods are provided to produce a modified polymeric fiber, film, sheet, ribbon, block or other structure having a controlled distribution of small cells located either continuously or at selected zones along the length and/or across the width to enhance opacity and provide an enhanced whitening effect at defined locations along the length and/or width of the modified structure.

These and other aspects, and advantages of the present invention become better understood with reference to the following figures, description, and appended claims. Of course, it is to be understood that while the invention has been generally described above and will hereinafter be described and disclosed in connection with certain exemplary embodiments, practices and procedures, it is by no means intended to limit the invention to such specific embodiments, practices and procedures as may be illustrated and described. Rather it is intended to cover all such alternatives and modifications thereto as may fall within the true spirit and scope of the invention.

BRIEF DESCRIPTION OF THE DRAWINGS

The invention may be further understood by reference to the accompanying figures which are incorporated in and which constitute a part of this specification and in which:

FIGS. 1A and 1B are micrograph images from sections of a PET (polyethylene terephthlate) filament yarn from an optical microscope illustrating the foamed cell structure within the filaments of such filament yarn;

DETAILED DESCRIPTION OF PREFERRED EMBODIMENTS

Figure 2A:
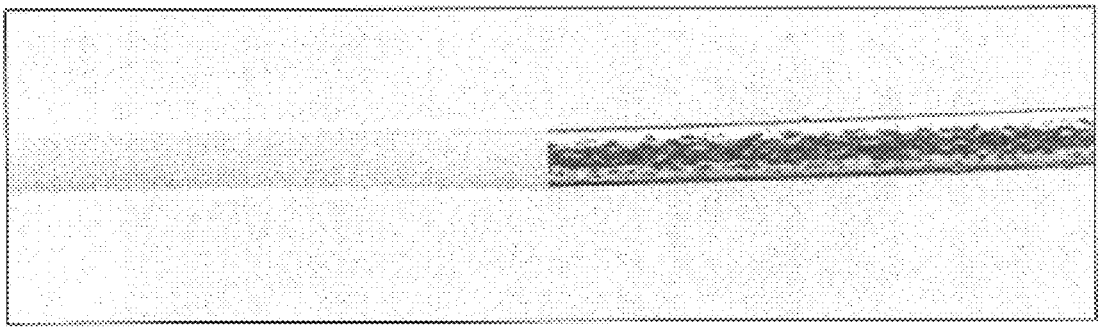
FIGS. 2A and 2B are micrographs of a PET filament illustrating controlled cell formation in a filament with cells concentrated in the center of a filament.

According to one aspect, the present invention is directed to a modified yarn or more specifically to modified fibers comprising the yarn. In this regard the present invention is not contingent upon any change to the basic manufacture of either the fibers or the yarn. Rather, the present invention is applicable to yarns produced from all species of polymeric fibers. Specifically, the present invention is directed to a modified polymeric fiber which includes a desired distribution of closed cells. Preferably, on average, a predominant portion of the resultant cells are characterized by an average length to diameter ratio of less than 500 and are more preferably characterized by a length to diameter ratio less than 50.

Fibers which may be modified in accordance with the present invention include, but are not limited to, thermoplastics such as polyesters, such as polyethylene terephthalate (PET), polyamides, such as any of a wide variety of nylons, and polyolefins, such as, preferably, polypropylene. Packaged yarn of the selected fiber is impregnated with a fluid, such as nitrogen, air, any noble gas, lower alkanes (like methane or ethane), $SF_6$, chlorofluorocarbons, or, preferably, carbon dioxide in order to induce foaming.

Specifically, the present invention anticipates as a first step that the selected fiber (which may be in either fiber, yarn or fabric form) is impregnated with a chosen fluid at a pressure greater than atmospheric pressure. That is, the fluid is forced into the fiber at levels which would not be maintained under normal atmospheric conditions. If desired, this impregnation may be aided by carrying out the pressurized impregnation at a reduced temperature. The pressurized environment sets up a non-equilibrium condition with a higher partial pressure of the fluid at the exterior of the fiber than at the interior. Thus, as the system seeks equilibrium, fluid is forced into the fiber. As will be appreciated, in a high pressure environment (maintained at a constant temperature) the ideal gas law dictates that the volume occupied by a given mass of gas is decreased and the density is increased. Reducing the temperature further reduces volume and increases density. Thus, under such conditions an increased mass of gas may be infused into the fiber.

Following pressurized infusion the pressure is then released allowing the previously infused fluid to expand to an increased volume and reduced density. Such increased gas volume gives rise to cellular expansion. If desired, the temperature may be raised (either uniformly or locally) to further drive volume increase and cellular expansion. However, dramatic increases in temperature in combination with pressure reduction may produce undue levels of out-diffusion which may be undesirable in some instances.

According to one exemplary practice, a polymeric fiber is impregnated with a chosen fluid a pressure greater than atmospheric pressure. The pressure is then reduced to atmospheric pressure. Thereafter, the fiber may be cooled to a temperature at or below the phase change temperature of the impregnating fluid. Thus, for example, if the impregnating fluid is carbon dioxide, the fiber is cooled to or below −78.5° C., the freezing point of carbon dioxide. Then, the fiber is heated to induce foaming and, finally, cooled to a temperature to terminate foaming.

In accordance with such an exemplary practice, a yarn of polymeric fiber is impregnated with a fluid by pressurizing the fluid over the packaged material in the range of from about 200 psi to about 5,000 psi or more (preferably about 500 psi to about 5000 psi or more) for a period of time extending from about one hour to more than 240 hours. As will be illustrated, the actual time and pressure depend on the fiber and desired level of closed cell formation. The fiber is then preferably cooled to at least the phase change temperature of the fluid. Concomitantly, the pressure is reduced to atmospheric pressure. Then, the fluid impregnated fiber preferably is held at atmospheric pressure and is heated to between about 50° C. and 300° C. to induce foaming. Finally, the yarn is cooled and subsequently processed for manufacture into a final product.

It is believed that the degree of foaming and hence the size, distribution, and quantity of closed cells, depends on the pressure under which the polymeric material is impregnated, the duration of the impregnation through exposure to elevated pressure, and subsequent heating conditions. As has been noted above, one aspect of the present invention is to provide a modified fiber which scatters light and, thereby, has an appearance of increased opacity thereby imparting a whitening effect to the fiber as compared to that of the fiber prior to modification. As such, the modified fiber may be produced without the inclusion of opacifying additives, such as, for example, titanium dioxide. In this regard it is to be understood that such additives may still be added if desired since the whitening effect provided by the cells is believed to be supplementary to the benefits provided by the additives.

Without wishing to be bound by a particular theory, the optical phenomena by which the present foamed fibers scatter light and give an appearance of whiteness may best be understood as follows. Generally, when light traveling through a first material or medium encounters the surface of a second material two things can occur, reflection and refraction. That is, light can reflect off the surface at an angle equal and opposite to the incident angle or the light can continue to travel through the second material. If the two materials have differing refractive indices the light will change direction as it passes through the surface, i.e., it will refract. If the light then passes through the second material and back into the first material the direction of the light will shift again.

For purposes of the present invention the simple optical phenomena of reflection and refraction are exploited by the shape, size and distribution of the closed, fluid-filled cells within the foamed fibers. Specifically, the present inventive foamed fibers contain a multitude of small, closed cells filled with fluid. As the transmittal light passes through the fiber it is refracted at each polymer/fluid interface and then again upon exiting the surface of the fiber. Thus, the combination of diffused reflection and refraction which occurs when light is applied to the present foamed fibers may best be termed diffused scattering. In essence, light scatters from the fiber in every possible direction thereby providing an appearance of enhanced whiteness.

As previously indicated, the fibers of the present invention are characterized by a large number of small closed cells having relatively low length to diameter (L/D) ratios. It should be noted that it has been found in accordance with the present invention that a large number of smaller cells having a low L/D ratio scatter light better than a smaller number of larger cells having a high L/D ratio. As was discussed above in the Background section, prior art methods of simultaneously extruding and foaming yield a relatively small number of high volume, highly elongated cells. Conversely, since the fibers of the present invention are already drawn and oriented prior to fluid impregnation, the cells do not undergo elongation during such processes and thus have much lower aspect ratios. In terms of performance, fibers containing a smaller number of long, narrow cells provide a lower degree of light scattering than the small cells of the present fibers. That is, fewer cells corresponds to fewer interfaces within the fiber for refraction of light. Also, long narrow cells have essentially linear, essentially parallel walls such that light takes a less tortuous path through the fiber. The closed cells of the present foamed fibers have a sufficiently low L/D ratio to provide a chaotic internal refraction path. However, it should be noted that the present closed cells are somewhat elongated in the longitudinal direction of the fibers. It is believed that this acceptable degree of elongation occurs because partially oriented yarns are employed as the precursor material.

Various aspects and advantages of this invention are illustrated by the following examples, which are provided for the purpose of representation, and are not to be construed as limiting the scope of the invention. The particular materials and amounts thereof, as well as other conditions and details, recited in these examples should not be used to unduly limit this invention.

EXAMPLE 1

FIG. 1A illustrates a modified yarn with closed-cells formed uniformly throughout its cross-section. FIG. 1B is an optical micrograph showing a side view of a fiber from the modified yarn. Based on optical microscopy measurements, cell length (L) was uniformly less than 14 $\mu$m and cell diameter (D) is less that 0.4 $\mu$m resulting in a L/D of less than 35. The modified yarn was a 255 denier, 34 filament partially oriented polyethylene terephthalate obtained from DuPont de Nemours having a place of business in Wilmington, Del. The yarn was pressurized to 800 psi with carbon dioxide and held at 0° C. for 72 hours to impregnate the fibers with fluid. Following the impregnation, the yarn was depressurized to atmospheric pressure and cooled in a container packed with dry ice (solid carbon dioxide, FP=−78.5° C.). The yarn was pulled from the cooled package through an eyelet and passed through a flat texturing machine at 600 meters/min. The draw ratio was 1.70. Subsequently, heat was applied with a contact heater set at 210° C. Finally, the yarn was air cooled and coated with 1% knit finish oil prior to winding on a package. Although part of the process of yarn production, the use of the flat texturing machine and finishing oil are not critical to the present desired fiber modification. However, tolerance to this processing does suggest that the modification has not adversely affected the strength and related processing features of the initial yarn.

EXAMPLE 2

Figure 2B:
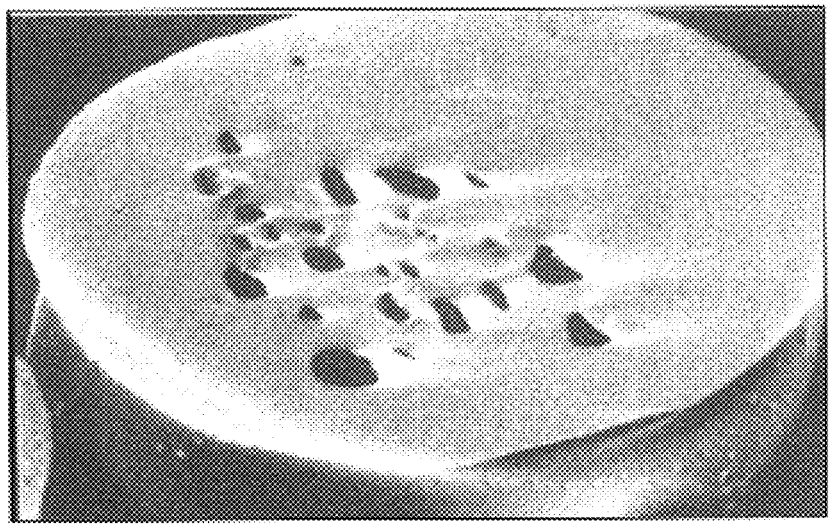

FIGS. 2A and 2B are respectively side view and end view images of fiber filaments from a modified yarn with closed cells concentrated in the inner core sections of the filaments and throughout the length. The modified yarn was a 225 denier, 200 filament partially oriented polyethylene terephthalate filament yarn obtained from DuPont, which was pressurized to 875 psi with carbon dioxide and held at 0° C. for 216 hours. Following this carbon dioxide impregnation, the yarn was depressurized to atmospheric pressure and cooled in a container packed with dry ice (solid carbon dioxide, FP=−78.5° C.). The yarn was pulled from the cooled package through an eyelet and passed through a flat texturing machine at approximately 521 meters/min. The draw ratio was 1.68. Heat was applied with a primary contact heater at 220° C. and with a secondary heater at 150° C. As shown, the filaments in the yarn foamed in their center uniformly along their length.

EXAMPLE 3

This example demonstrates the applicability of the present invention to nylon. Filament nylon 6,6 with 1.8 dpf, obtained from DuPont, was pretreated by soaking in 2-propanol for 3.5 hours and the surface was then blotted dry. The yarn was then pressurized to 760 psi with carbon dioxide and held at 0° C. for two hours after which it was depressurized to atmospheric pressure and cooled with dry ice/acetone (solid carbon dioxide, FP=−78.5C). The yarn was then placed in a polyethylene glycol (PEG 400) bath at 187° C. to induce foaming. Finally, the material was cooled in air to room temperature. Closed cells with low L/D ratios were achieved.

EXAMPLE 4

This example demonstrates the applicability of the present invention to polypropylene. Closed cells are formed uniformly in the inner core sections of a partially oriented, 220 denier solution dyed monofilament that had been pressurized to 5000 psi with carbon dioxide and held pressurized at 21° C. for four hours. The yarn was then depressurized to atmospheric pressure and cooled via Joule-Thompson cooling. The fiber was then placed in boiling water to induce foaming, followed by cooling in air to ambient temperature. The resulting modified fiber contained closed cells that were less than 10 $\mu$m in length and less than 0.2 $\mu$m in width for an L/D ratio of less than 50.

EXAMPLE 5

Figure 3A:
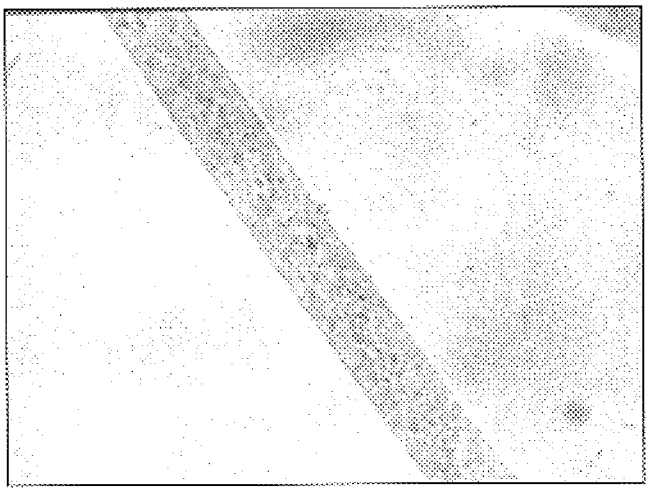
FIGS. 3A–3C are progressive views of cell formation within a PET filament illustrating the ability to selectively activate, control and deactivate cell formation to achieve desired characteristics.
Figure 3B:
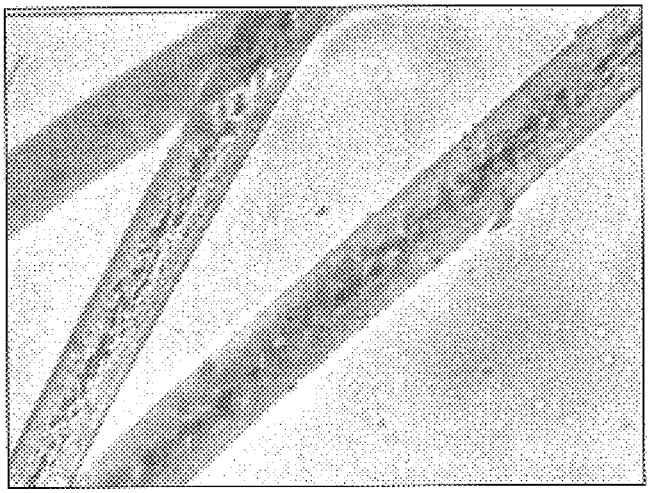
Figure 3C:
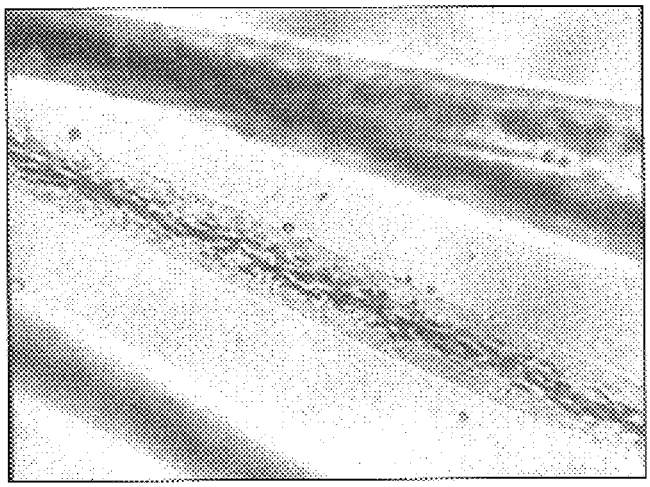

Control over the distribution of closed cells in a modified fiber is illustrated by FIGS. 3A–C. The initial fiber was 255 denier, 68 filament partially oriented polyethylene terephthalate filament yarn obtained from DuPont, which was pressurized with carbon dioxide to 750 psi, and held at that pressure at 0° C. for 48 hours, after which it was depressurized to atmospheric pressure and cooled with dry ice/acetone (solid carbon dioxide, FP=−78.5° C.). The yarn was pulled though an eyelet and passed through a false twist texturing machine at 551 meters/min. The draw ratio was 1.684 and the D/Y ratio 2.060. Heat was applied with a contact heater at 220° C. in the twisting section, utilizing a posi 5 friction unit with polyurethane discs and a 1-7-1 configuration. The setting section heater was set at 170° C. As it was drawn, the yarn was sequentially exposed to and removed from the primary heater. The resulting yarn had areas that lacked substantial numbers of closed cells where no heat was applied (FIG. 3A); areas with an intermediate number of closed cells where low levels of heat were applied (FIG. 3B); and areas with high concentrations of closed cells (where higher levels of heat had been applied). Thus, the formation as well as the concentration of closed cells may be controlled at will. The internal, longitudinal, controlled variation in the distribution of closed cells produced a finished product (yarn) with different levels of opacity (and thus whiteness) along its length.

Figure 4:
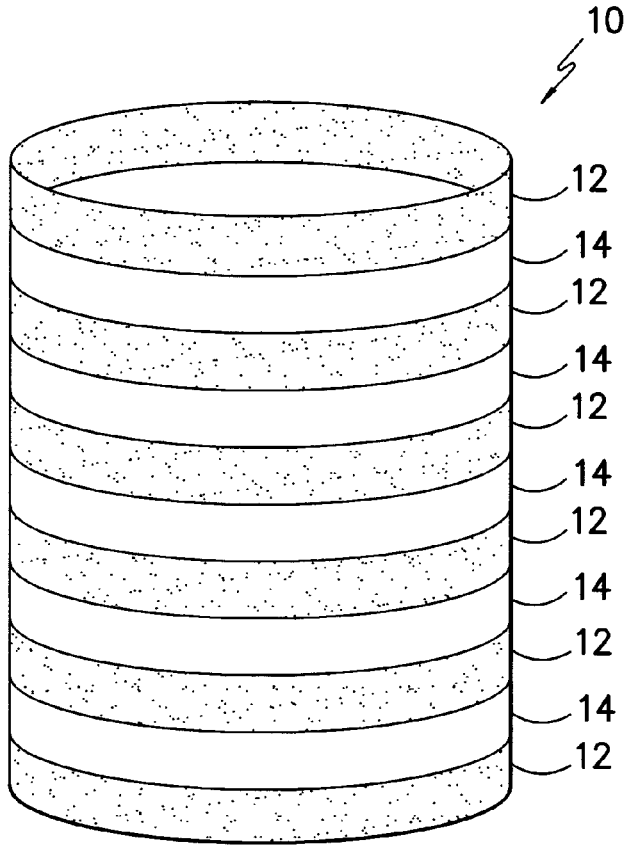
FIG. 4 illustrates a circular knit fabric structure formed from continuous yarns with segments having variable cell concentrations providing variable levels of opacity at zones within the fabric structure.

It is contemplated that the use of such a yarn with different levels of whiteness along its length may find any number applications in fabric constructions. By way of example only, in FIG. 4 there is illustrated a circular knit tube 10 having zones 12 formed from segments of a yarn with high concentrations of closed cells and cooperating zones 14 formed from segments of the same yarn with low concentrations of closed cells. In such a construction it will appear that two different yarns have been used since the zones 12 and 14 will have different levels of whiteness in an undyed state and will appear to adopt different shades when subjected to a uniform dye treatment. Thus, the appearance of a multi-yarn system may be realized without the use of different yarns.

EXAMPLE 6

Figure 5:
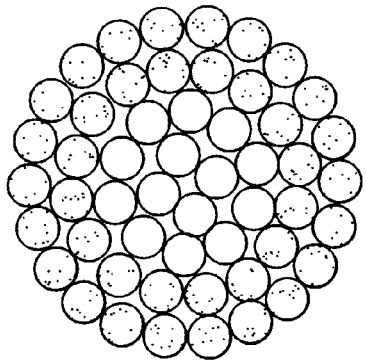
FIG. 5 illustrates a multi-filament yarn structure in which cell concentration is enhanced at the perimeter of the yarn.
Figure 6:
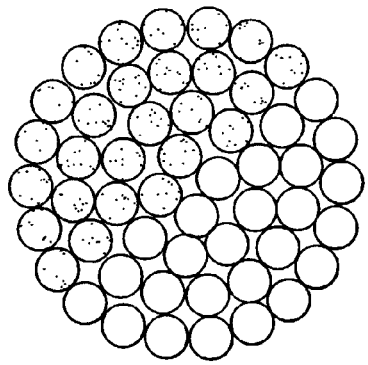
FIG. 6 illustrates a multi-filament yarn structure in which cell concentration is enhanced at one side of the yarn.

The ability to selectively concentrate cells at positions across the width of a yarn is illustrated by FIGS. 5 and 6. As represented by FIG. 5, a yarn with filaments on the outside having uniformly distributed closed-cells and filaments on the inside of the yarn having effectively no closed-cells was produced from 255 denier, 68 filament partially oriented polyethylene terephthalate filament yarn obtained from DuPont. The yarn was pressurized to 700 psi with carbon dioxide and held at that pressure at 0° C. for 48 hours, after which it depressurized to atmospheric pressure and cooled with dry ice (solid carbon dioxide, FP=−78.5 C). The yarn was then pulled through an eyelet and passed through a false twist texturing machine at 400 meters/min. The draw ratio was 1.648 and the D/Y ratio 3.0. Heat was applied with a controlled heater at 220° C. in the twisting section, utilizing a posi 5 friction unit with polyurethane discs and a disc configuration of 1-7-1. The setting section heater was set at 170° C. The tension across the friction unit was 0.47. The setting section heater was set at 170° C. Under the described conditions, the cross section of the yarn displayed variation in the cross-sectional distribution of closed cells with substantial levels of closed cells within the perimeter filaments but not at the interior.

It is also contemplated that by directionally heating one side of the yarn that closed cells may be generated within various sectional portions of the yarn. Accordingly, in FIG. 6 there is illustrated a yarn wherein substantial levels of closed cells occupy about one half of the yarn with the other half lacking such substantial levels of closed cells. Of course, virtually any other segment geometry as may be desired may likewise be utilized.

Importantly, the practices of the present invention make it possible to selectively vary both the occurrence and the concentration of closed cells at will at virtually any location along the length or across the width of a precursor structure. For example, applying heat at a selected location for a longer period of time (or at a higher temperature) will form a greater concentration of cells at that location than a lower temperature or a short heating duration. As will be appreciated, the localized nature of such control provides a substantial degree of freedom in imparting desired cellular characteristics to the fiber, yarn or other precursor structure. This, in turn, allows for the development of complex patterns of varying cellular concentrations to be developed within the structure such that different zones along and/or across the structure have different levels of whiteness and impart different appearances when treated by dyes or other colorants.

It is, of course, to be appreciated that while several exemplary embodiments, procedures and practices have been shown and described, the invention is in no way to be limited thereto, since modifications may be made and other embodiments of the principles of this invention will no doubt occur to those skilled in the art upon review of this specification and/or through practice of the invention. In particular, it is contemplated that the pressurized impregnation and subsequent foaming procedures described in relation to preformed fibers and yarns will likewise be applicable to numerous other polymeric constructions. More specifically, it is contemplated that the practices of the present invention and the resultant controlled closed cell geometry may be applied to virtually any polymeric precursor structure. By way of example only, and not limitation, it is contemplated that such precursor structures may include films, sheets, ribbons and blocks of any of the polymeric materials previously identified as being suitable for fibers. Therefore, it is to be understood that the present invention extends to these and other modifications and variations as may be utilized without departing from the principles and scope of the invention and it is contemplated by the appended claims to cover any such modifications and other embodiments as may incorporate the features of this invention within the true spirit and scope thereof.

That which is claimed is:

1. A modified polymeric fiber having a length in a longitudinal direction and a cross-section perpendicular to the longitudinal direction, the fiber comprising closed cells, the closed cells having a length in the longitudinal direction of the polymeric fiber and a diameter perpendicular to the longitudinal direction of the fiber, the closed cells having an average length to diameter ratio of less than about 500.

2. The modified polymeric fiber of claim 1 wherein the closed cells have an average length to diameter ratio of less than about 50.

3. The modified polymeric fiber of claim 1 comprising a polyester.

4. The modified polymeric fiber of claim 3 wherein the polyester comprises polyethylene terephthalate.

5. The modified polymeric fiber of claim 1 comprising a polyamide.

6. The modified polymeric fiber of claim 1 comprising a polyolefin.

7. The modified polymer of claim 6 wherein the polyolefin comprises polypropylene.

8. The modified polymeric fiber of claim 1 wherein the closed cells are uniformly distributed throughout the length of the fiber.

9. The modified polymeric fiber of claim 1 wherein the closed cells are uniformly distributed throughout the cross-section of the fiber.

10. The modified polymeric fiber of claim 1 wherein the closed cells are distributed in foamed segments of the fiber and further comprising non-foamed segments devoid of closed cells.

11. The modified polymeric fiber of claim 1, wherein the closed cells are distributed substantially non-uniformly along the length of the fiber such that predefined zones along the length of the fiber are characterized by predefined different concentrations of closed cells.

12. The modified polymeric fiber of claim 1, wherein the closed cells are distributed substantially non-uniformly within the cross-section of the fiber such that predefined zones within the cross-section are characterized by predefined different concentrations of closed cells.

13. A yarn comprising modified polymeric fibers, each polymeric fiber having a length in a longitudinal direction and a cross-section perpendicular to the longitudinal direction, the yarn having a length in the longitudinal direction of the polymeric fibers and a cross-section perpendicular to the longitudinal direction, the cross-section of the yarn comprising an inner, core section of fibers and an outer, circumferential section of fibers, the fibers comprising closed cells, the closed cells having a length in the longitudinal direction of the polymeric fiber and a diameter perpendicular to the longitudinal direction of the fiber, the closed cells having an average length to diameter ratio of less than about 500.

14. The yarn of claim 13 wherein the closed cells have an average length to diameter ratio of less than about 50.

15. The yarn of claim 13 wherein the fibers comprise a polyester.

16. The yarn of claim 15 wherein the polyester comprises polyethylene terephthalate.

17. The yarn of claim 13 wherein the fibers comprise a polyamide.

18. The yarn of claim 13 wherein the fibers comprise a polyolefin.

19. The yarn of claim 18 wherein the polyolefin comprises polypropylene.

20. The yarn of claim 13 wherein the closed cells are uniformly distributed throughout the length of the fibers.

21. The yarn of claim 13 wherein the closed cells are uniformly distributed throughout the cross-section of the yarn.

22. The yarn of claim 13 wherein the closed cells are selectively distributed throughout the outer, circumferential section of fiber of the cross-section of the yarn.

23. The yarn of claim 13 wherein the closed cells are distributed in foamed segments of the fibers of the yarn and further comprising non-foamed segments of the fibers of the yarn devoid of closed cells.

24. The yarn of claim 13, wherein the closed cells are distributed substantially non-uniformly along the length of the yarn such that predefined zones along the length of the yarn are characterized by predefined different concentrations of closed cells.

25. The yarn of claim 13, wherein the closed cells are distributed substantially non-uniformly within the cross-section of the yarn such that predefined zones within the cross-section are characterized by predefined different concentrations of closed cells.

* * * * *